US006953245B2

(12) United States Patent
Shirakawa

(10) Patent No.: US 6,953,245 B2
(45) Date of Patent: Oct. 11, 2005

(54) INK-JET PRINTING APPARATUS AND INK-JET PRINTING METHOD

(75) Inventor: Hiroaki Shirakawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/180,113

(22) Filed: Jun. 27, 2002

(65) Prior Publication Data

US 2003/0011670 A1 Jan. 16, 2003

(30) Foreign Application Priority Data

Jun. 29, 2001 (JP) ..... 2001/199987

(51) Int. Cl.[7] ..... B41J 2/01
(52) U.S. Cl. ..... 347/102; 400/120.1; 400/124.3
(58) Field of Search ..... 347/102; 400/120.01, 400/124.03

(56) References Cited

U.S. PATENT DOCUMENTS 5,130,726 A 7/1992 Fukushima et al.
5,192,973 A * 3/1993 Hickisch ..... 355/215
5,784,090 A * 7/1998 Selensky et al. ..... 347/102
5,936,008 A * 8/1999 Jones et al. ..... 523/161
6,092,890 A 7/2000 Wen et al.
6,102,506 A * 8/2000 Sasai et al. ..... 347/3
6,425,663 B1 * 7/2002 Eastlund et al. ..... 347/102

FOREIGN PATENT DOCUMENTS

JP 60-132767 7/1985
JP 63062738 A * 3/1988

* cited by examiner

*Primary Examiner*—Stephen Meier
*Assistant Examiner*—Ly T Tran
(74) *Attorney, Agent, or Firm*—Fitzpatrick, Cella, Harper & Scinto

(57) ABSTRACT

An ink-jet printing apparatus and an ink-jet printing method are provided which can improve a quick-drying performance of an ink containing an ultraviolet curing agent while at the same time preventing harm done by ink mist. When the printing head ejects ink containing the ultraviolet curing agent from the ink ejection portions as it moves, the ultraviolet radiation unit provided in front of the printing head with respect to the printing head moving direction radiates the ultraviolet light onto the ink adhering to the printing medium.

7 Claims, 11 Drawing Sheets

INK-JET PRINTING APPARATUS AND INK-JET PRINTING METHOD

This application is based on Patent Application No. 2001-199987 filed Jun. 29, 2001 in Japan, the content of which is incorporated hereinto by reference.

BACKGROUND OF THE INVENTION

1. Field of the Invention

The present invention relates to an ink-jet printing apparatus and an ink-jet printing method for printing on a printing medium by using a printing head capable of ejecting ink.

2. Description of the Related Art

The ink-jet system performs printing by projecting ink droplets (printing liquid droplets) from nozzles of the printing head onto the printing medium.

The serial printer of such a construction has a problem that when the surface of a printing medium is rubbed immediately after an image has been printed, the printed image may be spoiled or the surface of the printing medium may be smeared. Further, when a plurality of color inks are used for printing, different color inks may flow over a boundary into each other's area (bleeding), degrading an image quality. To deal with these problems, an ink-jet printing apparatus was proposed which uses inks containing ultraviolet-curing agents and radiates ultraviolet light on the printed surface immediately after printing to improve a quick drying performance of the printed surface (Japanese Patent Application Laid-Open No. 60-132767 (1985) and U.S. Pat. No. 6,092,890).

The Japanese Patent Application Laid-Open No. 60-132767 (1985) (hereinafter referred to as a "first prior art") is intended to provide a highly reliable ink-jet printer that can prevent ink clogging and an ink-jet printer that can prevent the printed surface from getting smeared with ink even when touched by a hand immediately after printing. More specifically, the ink-jet printer uses ultraviolet-curable inks as inks to be ejected from the ink-jet printing head and radiates ultraviolet light after the inks have landed on the printing medium for their drying and fixing. Ultraviolet lamps are installed at both ends of the printing head. When the printing head is moving to the right, the left side ultraviolet lamp is used to fix the ink. When the printing head is moving to the left, the right side ultraviolet lamp is used for ink fixing. The first prior art also describes another example construction in which an ultraviolet lamp with its length corresponding to the width of the printing medium is fixedly installed at a position on the printing medium discharge side with respect to the printing head so as to fix the inks through ultraviolet radiation.

U.S. Pat. No. 6,092,890 (hereinafter referred to as a "second prior art") is intended to provide an image forming apparatus capable of forming on an image carrier a durable image free of bleeding. In more concrete terms, the apparatus has an printing head for ejecting ultraviolet-curable inks and an ultraviolet radiation unit connected to the printing head. The image carrier, the ink-jet head and the ultraviolet radiation unit are movable relative to each other. An input digital image is formed on the image carrier by scanning a plurality of printing heads over the image carrier, with the ultraviolet radiation unit shining in each scan ultraviolet light that solidifies the inks on the image carrier.

These conventional apparatus, however, do not consider a problem of ink mist produced during printing, i.e., the adverse effects that fine ink droplets (other than the intended main ink droplets) floating over the printing medium have on the print quality. The generated mist flows rearward as the printing head scans. Thus, when the ultraviolet light is radiated immediately after printing as in the conventional apparatus, the mist also is subjected to the ultraviolet light and becomes solidified. As a result, the solidified fine ink particles are scattered over the printed surface of the printing medium, degrading the quality of the printed image. Further, a part of the mist flies to the ultraviolet radiation unit where it may be hardened and accumulate. In that case, the ultraviolet light emitted from the ultraviolet radiation unit may weaken in intensity. Further, when an ultraviolet lamp with its length corresponding to the width of the printing medium is used, as in the second example of the first prior art, the cost increases. In addition, because it takes time for the printed ink to become fixed, when a plurality of color inks are used for printing in particular, the ink bleeding at a boundary between different color ink areas adversely affects the image.

SUMMARY OF THE INVENTION

An object of the present invention is to provide an ink-jet printing apparatus and an ink-jet printing method which can improve a quick-drying performance of an ink containing an ultraviolet curing agent while at the same time preventing harm done by ink mist.

In the first aspect of the present invention, there is provided an ink-jet printing apparatus using a printing head capable of ejecting ink from ink ejection portions to print on a printing medium while the printing head moves reciprocally in main scan directions, wherein the printing head is able to eject ink containing an ultraviolet curing agent; and comprising an ultraviolet radiation unit to radiate an ultraviolet light onto the ink adhering to the printing medium from a position in front of the ink ejection portions with respect to the moving direction of the printing head.

In the second aspect of the present invention, there is provided an ink-jet printing apparatus using a printing head capable of ejecting ink from ink ejection portions to print on a printing medium while the printing head moves reciprocally in main scan directions, wherein the printing head is able to eject ink containing an ultraviolet curing agent; and comprising an ultraviolet radiation unit to radiate an ultraviolet light onto the ink adhering to the printing medium when the printing head, after having ejected the ink while moving in one of the main scan directions, moves in the other of the main scan directions.

In the third aspect of the present invention, there is provided an ink-jet printing method using a printing head capable of ejecting ink from ink ejection portions to print on a printing medium while the printing head moves reciprocally in main scan directions, comprising the steps of:

when the printing head ejects ink containing an ultraviolet curing agent while moving the printing head, radiating an ultraviolet light onto the ink adhering to the printing medium from a position in front of the ink ejection portions with respect to the moving direction of the printing head.

In the fourth aspect of the present invention, there is provided an ink-jet printing method using a printing head capable of ejecting ink from ink ejection portions to print on a printing medium while the printing head moves reciprocally in main scan directions, comprising the steps of:

ejecting from the printing head the ink containing a ultraviolet curing agent while moving the printing head in one of the main scan directions; and after the ejecting step, when the printing head moves in the other of the main scan directions, radiating the ultraviolet light onto the ink adhering to the printing medium.

In this invention, when the printing head ejects ink containing an ultraviolet curing agent from the ink ejection portions as it moves, an ultraviolet light is emitted onto the ink adhering to the printing medium from a position in front of the ink ejection portions with respect to the printing head moving direction. This prevents the ink mist flowing rearward with respect to the head moving direction from being radiated with the ultraviolet light. As a result, it is possible to prevent a degradation of image quality that would be caused by the ink mist hardened through the radiation of the ultraviolet light being scattered over the printing medium and therefore harm caused by the ink mist.

Further, with this invention, the ink containing an ultraviolet curing agent is ejected while moving in one of the main scan directions and, after that, when the printing head moves in the other of the main scan directions, an ultraviolet light is shed on the ink adhering to the printing medium. Therefore, the printing head is moving in one of the main scan directions and shining an ultraviolet light when the printing head is moving in the other of the main scan directions. Accordingly, application of the ultraviolet light to the ink mist is avoided, thereby preventing harm done by the ink mist.

Further, this invention provides a shutter that shields the ultraviolet radiation unit when the unit does not shine the ultraviolet light. This reliably prevents a harm done by the ink mist when it adheres to the ultraviolet radiation unit.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, embodiments of the present invention will be described by referring to the accompanying drawings.

(Basic Construction of Printing Apparatus)

Figure 9:
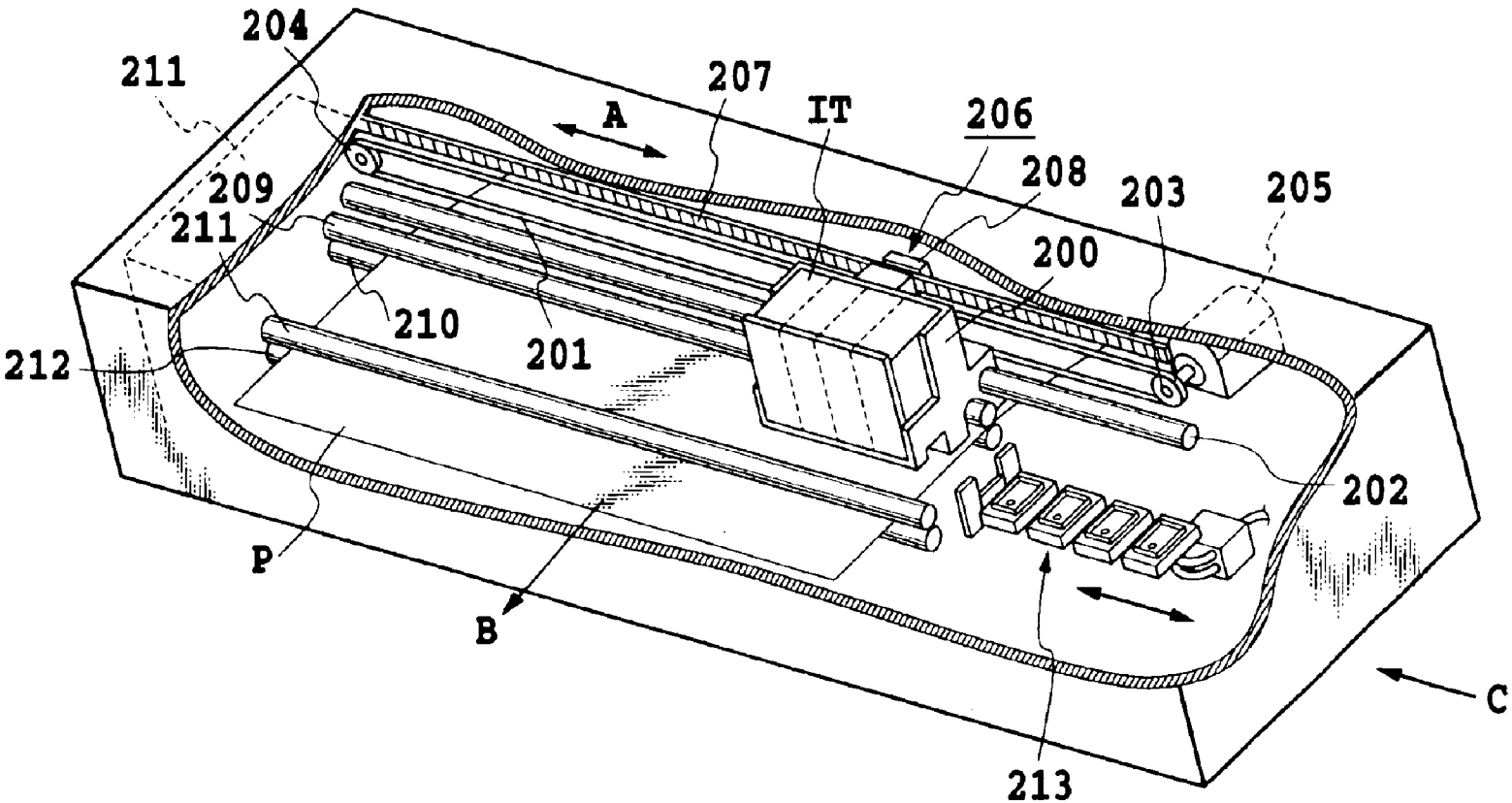
FIG. 9 is a perspective view showing a basic construction of the ink-jet printing apparatus of the present invention.

FIG. 9 is a conceptual perspective view showing a construction of an ink-jet printing apparatus. In this example of the ink-jet printing apparatus, a carriage 200 is connected to an endless belt 201 and movable along a guide shaft 202. The endless belt 201 is wound around pulleys 203 and 204. The pulley 203 is mounted on a drive shaft of a carriage drive motor 205. Thus, as the motor 205 rotates, the carriage 200 is reciprocally moved along the guide shaft 202 in the main scan direction, as indicated by an arrow A. Mounted on the carriage 200 are printing heads 10 (not shown in FIG. 9) each having an array of ink ejection nozzles and ink tanks IT each containing ink.

The printing head 10 has an ink ejection surface facing printing paper P as a printing medium. On the ink ejection surface, a plurality of ink ejection nozzles are arranged in a paper feeding direction (sub scan direction indicated by an arrow B). The printing head 10 also has ink passages communicating with the corresponding nozzles and electrothermal transducers provided for the associated ink passages to generate thermal energy for ejecting ink. Each of the electrothermal transducers is applied an electric pulse according to drive data to generate heat. The heat thus generated causes a film boiling in the ink whereby a bubble is formed in the ink and causes an ink droplet to eject. The ink passages are connected to a common liquid chamber which is connected to the ink tank IT.

The printing apparatus of this example has a linear encoder 206 for detecting the position of the carriage 200 as it is moved. That is, a linear scale 207 provided in the direction of movement of the carriage 200 has slits formed at equal intervals, for example at a pitch of 1200 slits per inch. On the carriage 200, a slit detection system 208 with a light emitter and a light receiving sensor and a signal processing circuit are provided. Hence, the encoder 206 outputs an ejection timing signal representing an ink ejection timing and information on the position of the moving carriage 200, according to the moving of the carriage 200. Ejecting ink each time a slit on the linear scale 207 is detected can perform printing with a resolution of 1200 dpi in the main scan direction.

The printing paper P as a printing medium is fed intermittently in a sub scan direction, indicated by an arrow B, perpendicular to the main scan direction of the carriage 200. The printing paper P is supported by a roller unit of paired rollers 209, 210 and another roller unit of paired rollers 211, 212, these two roller units being located upstream and downstream, respectively, with respect to the feed direction. The printing paper P is also applied a predetermined tension by these roller units to secure a planarity relative to the printing head 10. In this condition the paper P is fed. In this example, the drive force to the roller units is supplied from a paper feed motor (not shown).

With the printing apparatus of the above construction, the entire area of the paper P can be printed by alternately repeating, while moving the carriage 200, the printing over a width corresponding to the length of the nozzle array of the printing head 10 and the feeding of the paper P.

The carriage 200 is stopped at a home position at the start of or during the printing operation as required. The home position is provided with cap members 213 that cap the ink ejection surfaces of the printing heads. The cap members 213 are each connected with a suction recovery means (not shown) that forcibly draws ink from the nozzles by suction to prevent a possible clogging of the nozzles.

Figure 10:
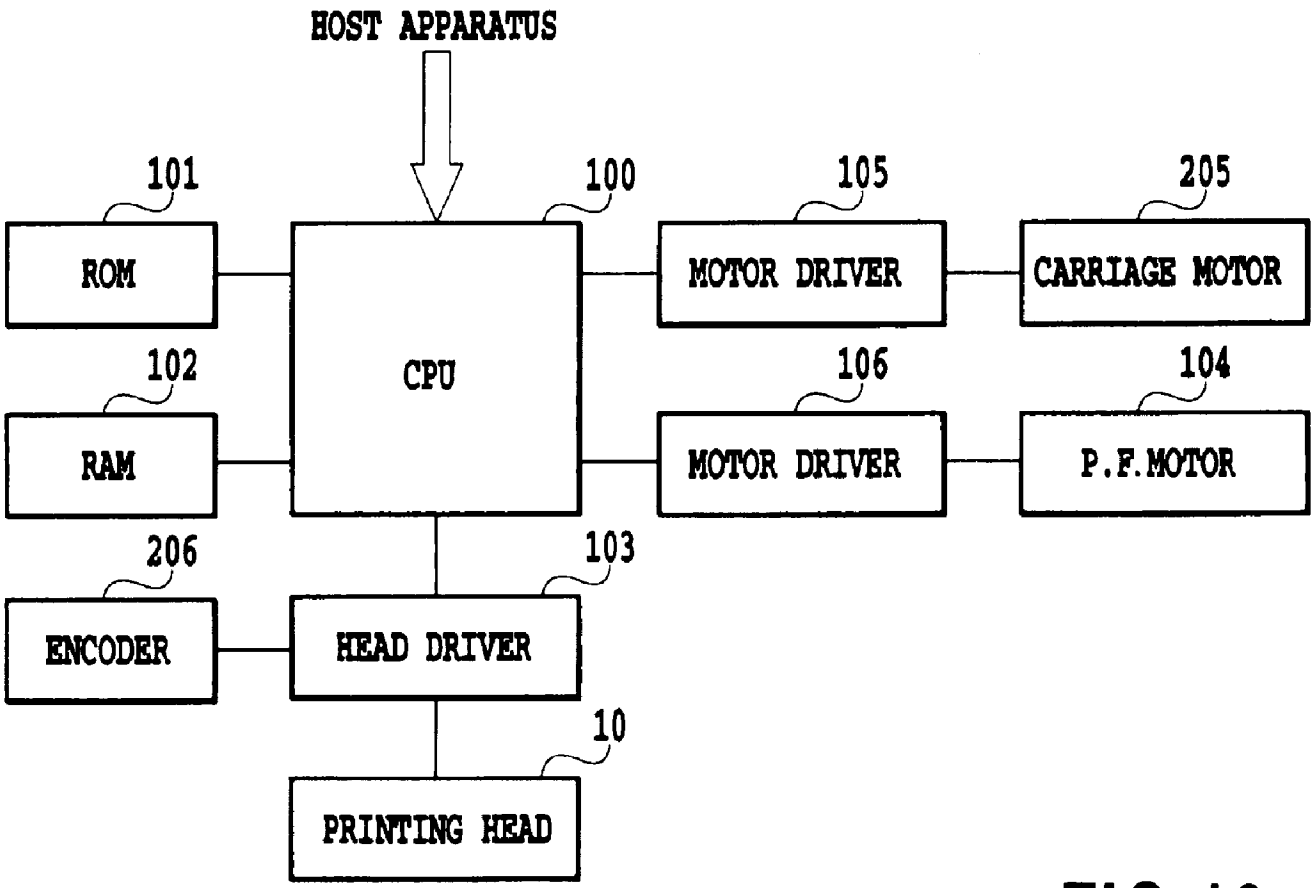
FIG. 10 is a block diagram showing a configuration of a control system in the ink-jet printing apparatus of FIG. 9.

FIG. 10 is a block diagram showing a configuration of a control system in the ink-jet printing apparatus.

A CPU 100 receives print information from a host and performs control on various portions in the printing apparatus and processed data. A ROM 101 stores programs for various processing and a RAM 102 is used as a work area by the CPU 100 when executing processing. That is, based on the control program stored in the ROM 101, the CPU 100 processes print information received from the host by using peripheral units such as RAM 102 to convert the print information into print data. The CPU 100 also outputs to a head driver 103 drive data, i.e., print data and drive control signal, for the electrothermal transducers of the printing head 10. The head driver 103, based on the drive data received, drives the electrothermal transducers of the printing head 10, The CPU 100 controls, through motor drivers 105, 106, a carriage drive motor (carriage motor) 205 for reciprocally moving the carriage 200 and a paper feed (PF) motor 104 for feeding the printing paper P. The head driver 103 is supplied with the ejection timing signal and the carriage position information from the encoder 206.

Figure 11:
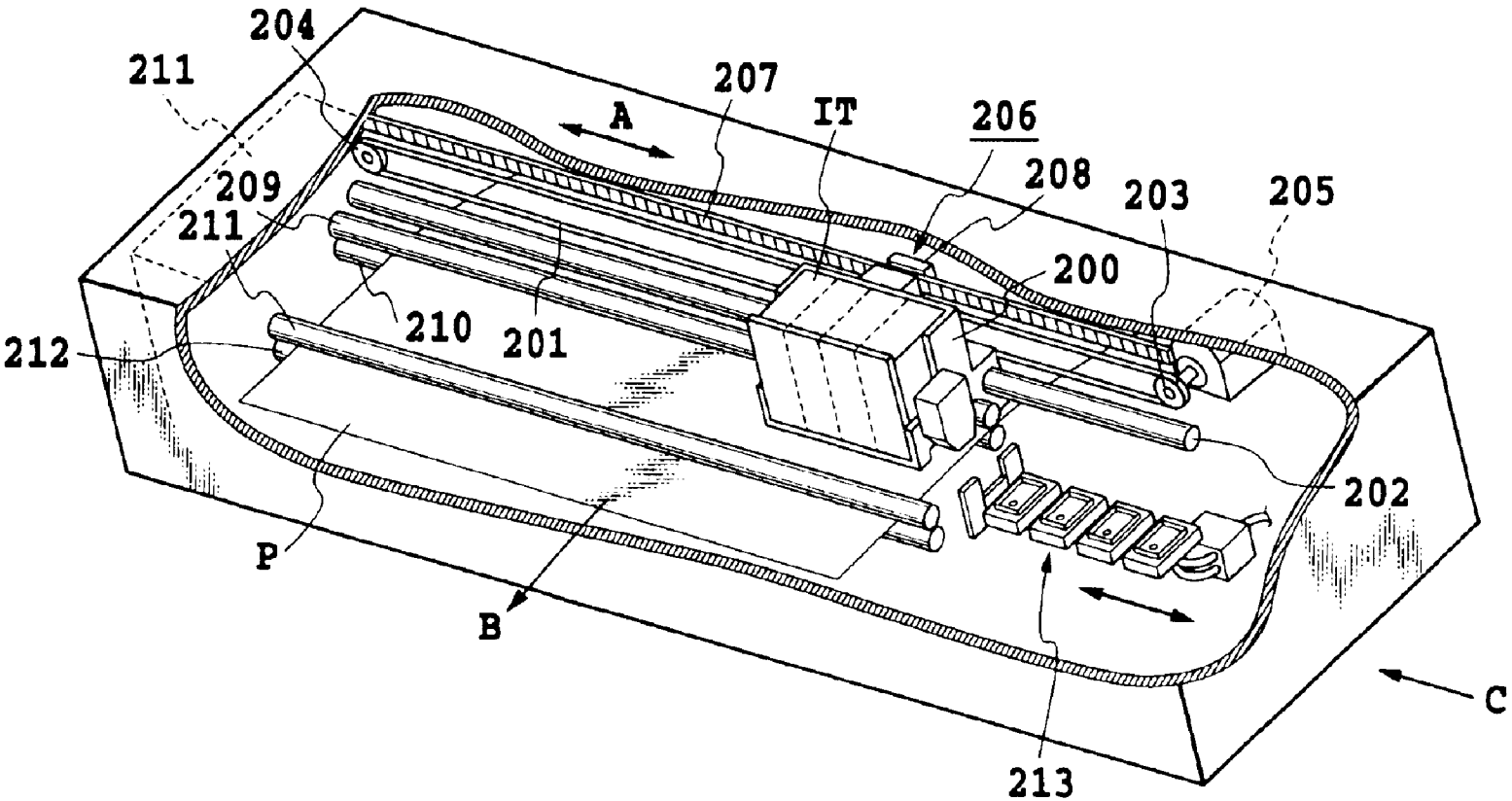
FIG. 11 is a perspective view showing an example construction of the ink-jet printing apparatus of FIG. 9 provided with an ultraviolet radiation unit

FIG. 11 is a perspective view of the ink-jet printing apparatus of FIG. 9 with ultraviolet radiation units 20 attached to the carriage 200. In this example, the ultraviolet radiation units 20 are provided at both ends, with respect to the main scan direction A, of the carriage 200 (the one on the far side is not shown). After inks containing an ultraviolet-curable agent have been ejected for printing, the ultraviolet radiation unit 20 shines an ultraviolet light onto the printed surface to help quicken the drying of the printed surface.

As for the material of the ink, a first example material is a compound made up of a pigment as a colorant, water, a liquid water-soluble polymeric compound and a water-soluble photopolymerization initiator. In this example, the liquid water-soluble polymeric compound exhibits a slow-drying characteristic, so the ink does not include a nonvolatile hydrophilic solvent such as used in general water-based ink-jet inks. A second example of the ink material is a compound made up of a pigment as a colorant, water, a water-soluble organic solvent, a liquid water-soluble ultraviolet-curable resin, and a water-soluble photopolymerization initiator. Of these materials, the water-soluble polymeric substance and the water-soluble photopolymerization initiator, both of which are cured by ultraviolet light, will be explained regarding their components.

For the water-soluble polymeric substance that is cured by ultraviolet light, a monofunctional or polyfunctional polymeric compound may be used. Particularly desirable is a compound which has two or more acryloyl groups in one molecule and a water solubility of 10% or more by weight. Very few substances have been known so far which can dissolve in water and have a low viscosity, a photopolymeric characteristic and an excellent physical property a cured film. The water-soluble polyfunctional substances typically have a polyethylene glycol structure. But these water-soluble substances have a poor water resistance as a cured film and also have limitations on the kinds of base materials to which it adheres well. Acrylate derived from epichlorohydrin-added compounds of polyhydric alcohol, or a group of compounds generally called epoxy acrylate, has a high water solubility, a fast ultraviolet curing rate and a good physical property as a cured film. But because these compounds have a large number of hydroxyl groups, their viscosity is relatively high. Therefore, their use in ink may be limited. The use of a liquid, hydrophilic, nonvolatile, ultraviolet-curable, polymeric compound with a high water absorbability can form an aqueous ink-jet ink of the first example material not containing a nonvolatile organic solvent. One of the polyfunctional polymeric compounds is a (meta) acrylate of polyhydric alcohol. Water-soluble compounds in this category include polyethylene glycol #200 diacrylate, which is an acrylate of polyethylene glycol. It is also possible to use nonionic, water-soluble polymeric compounds. Such polymeric compounds include (meta) acrylate of a polyol having two or more hydroxyl groups, such as monosaccharide and disaccharide; and (meta) acrylate of triethanolamine, diethanolamine, trishydroxy aminomethane and trishydroxy aminoethane. These compounds are desirable because they have a part of the basic features of this invention, such as water solubility and polymerization capability. The contents of these polymeric compounds in the ink are 1–40% by weight, preferably 1–5 times the content of the colorant. That is, if the colorant content is 3% by weight, their preferred contents are 3–15% by weight.

Possible water-soluble photopolymerization initiators may include water-soluble organic compounds of quaternary ammonium base, such as 4-benzoyl-N,N,N-trimethyl benzene methane ammonium chloride, 2-hydroxy 3-(4-benzoyl-phenoxy)-N,N,N-trimethyl 1-propane ammonium chloride, and 4-benzoyl-N,N-dimethyl N-[2-(1-oxo-2-propenyloxy) ethyl] benzene methane ammonium bromide.

(First Embodiment)

Figure 1A:
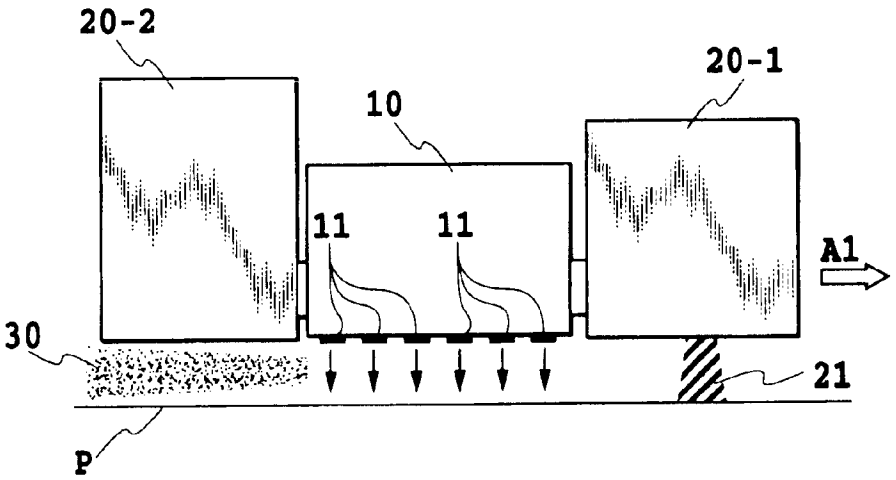
FIG. 1A is an explanatory diagram showing a printing head moving in one direction in a first embodiment of the present invention.
Figure 1B:
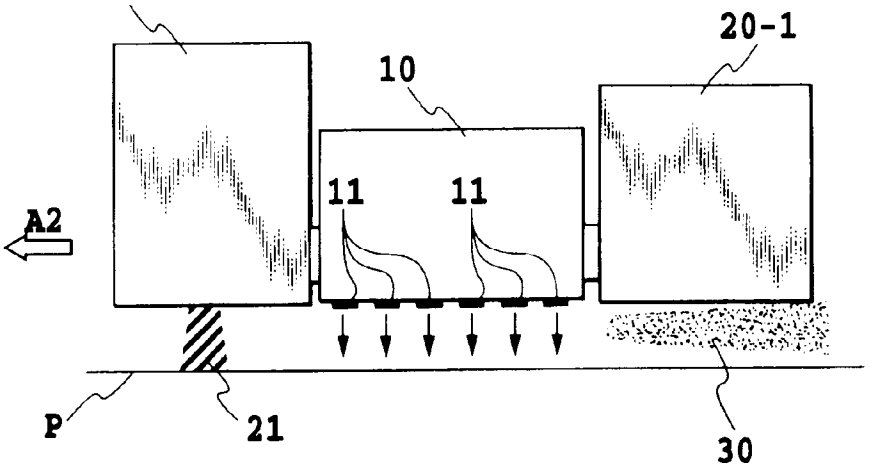
FIG. 1B is an explanatory diagram showing the printing head moving in the opposite direction in the first embodiment of the present invention.

FIG. 1A and FIG. 1B best illustrate the features of the first embodiment of the present invention.

In this example, ultraviolet radiation units 20 (20-1, 20-2) are provided at both ends of the printing head 10 in the ink-jet printing apparatus of FIG. 11. As shown in FIG. 1A, when the printing head 10 is moving toward the right in the direction of arrow A1, ink ejection portions 11 of the printing head 10 eject ink and at the same time the right-side ultraviolet radiation unit 20-1 radiates an ultraviolet light 21. When, as shown in FIG. 1B, the printing head 10 is moving toward the left in the direction of arrow A2, the ink ejection portions 11 of the printing head 10 eject ink and at the same time the left-side ultraviolet radiation unit 20-2 radiates the ultraviolet light 21. Therefore, the ultraviolet light 21 is radiated from the ultraviolet radiation unit 20 situated on the front side of the printing head 10 with respect to the scan direction. The ultraviolet light 21 fixes the ink on a printed area of the paper that was printed in the previous scan. Thus, when an image in a predetermined area on the printing paper P is to be completed with a plurality of scans of the printing head 10, the ultraviolet light 21 does not need to be radiated during the first scan of the printing head 10. After the last scan for the image printing, the printing head 10 must be scanned one more time for radiating of the ultraviolet light 21.

Mist 30 generated during the printing flows rearward with respect to the scan direction as the printing head 10 performs the scan, so that it is not subjected to the ultraviolet light 21 from the ultraviolet radiation unit 20 situated in front with respect to the scan direction. This printing control can prevent the harm done by the mist 30 when subjected to the ultraviolet radiation, i.e., the degradation of a printed image by the mist 30 hardened through ultraviolet radiation being scattered over the printed surface of the printing paper P. Further, two or more of the ink ejection portions 11 are provided in the scan direction of the printing head 10, each being adapted to, for example, eject a different color of ink.

(Second Embodiment)

Figure 2A:
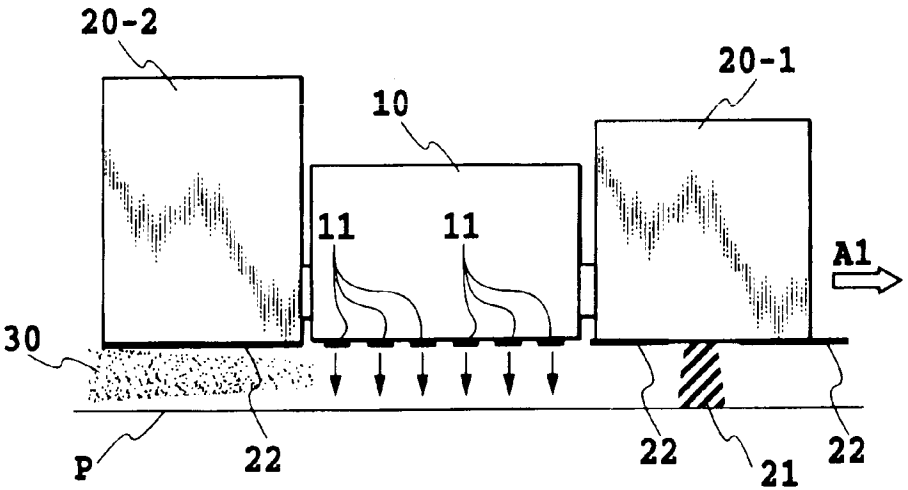
FIG. 2A is an explanatory diagram showing the printing head moving in one direction in a second embodiment of the present invention.
Figure 2B:
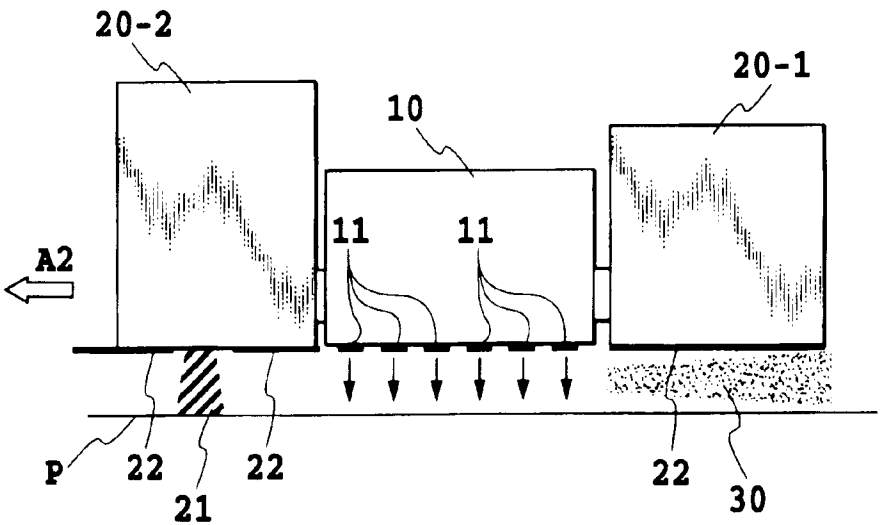
FIG. 2B is an explanatory diagram showing the printing head moving in the opposite direction in the second embodiment of the present invention.

FIG. 2A and FIG. 2B best illustrate the features of the second embodiment of the present invention.

The apparatus of this embodiment has shutters 22 attached to the ultraviolet radiation units 20 (20-1, 20-2) of the first embodiment. The shutter 22 on the right side ultraviolet radiation unit 20-1 opens to form a passage for the ultraviolet light 21 when the ultraviolet radiation unit 20-1 radiates the ultraviolet light 21, i.e. when the printing head 10 moves to the right in the direction of arrow A1 as shown in FIG. 2A. The shutter 22 on the left side ultraviolet radiation unit 20-2 opens to form an ultraviolet light passage when the ultraviolet radiation unit 20-2 radiates the ultraviolet light 21, i.e. when the printing head 10 moves to the left in the direction of arrow A2 as shown in FIG. 2B. The shutters 22 are closed to shield the corresponding ultraviolet radiation units 20-1, 20-2 when they do not radiate the ultraviolet light 21.

The mist 30 generated during the printing flows toward the ultraviolet radiation unit 20 situated on the rear side with respect to the scan direction. Because the shutter 22 on the ultraviolet radiation unit 20 located on the rear side with respect to the scan direction is closed, the mist 30 flowing rearward does not adhere to the ultraviolet radiation unit 20, thus preventing a possible reduction in intensity of the ultraviolet radiation that would otherwise be caused by the adhesion of the mist 30.

(Third Embodiment)

Figure 3A:
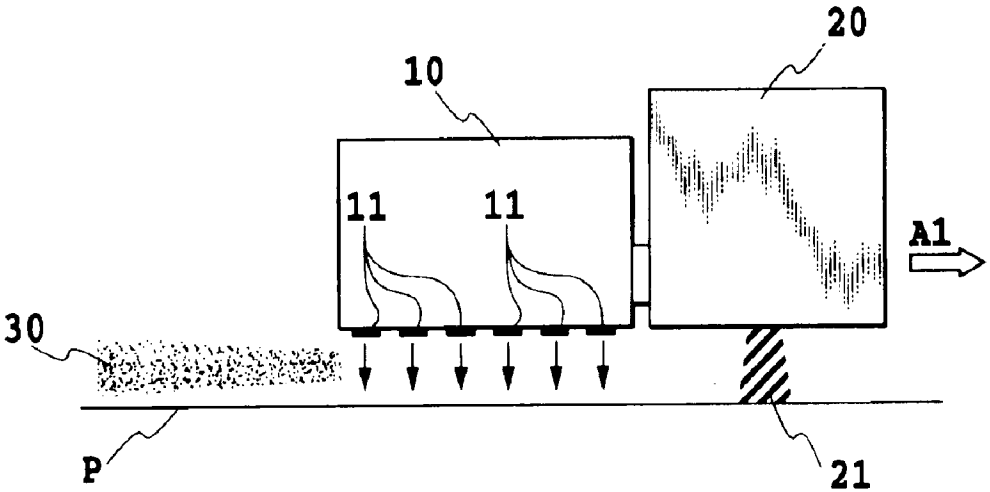
FIG. 3A is an explanatory diagram showing the printing head moving in one direction in a third embodiment of the present invention.
Figure 3B:
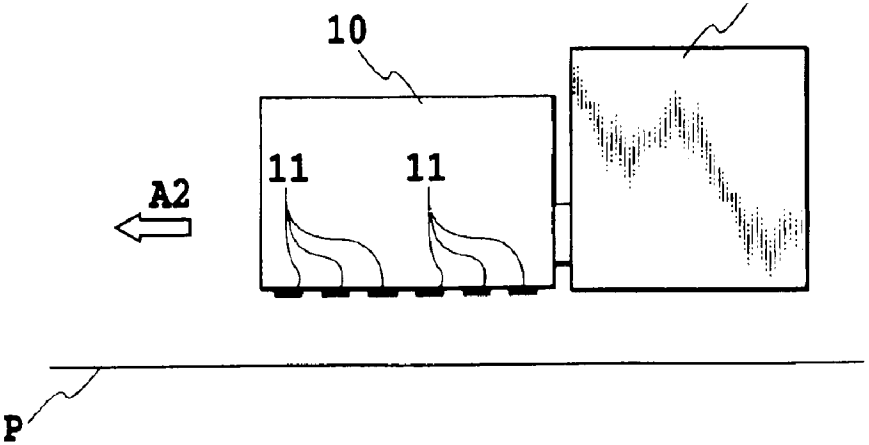
FIG. 3B is an explanatory diagram showing the printing head moving in the opposite direction in the third embodiment of the present invention.

FIG. 3A and FIG. 3B best illustrate the feature of the third embodiment of the present invention.

This embodiment has an ultraviolet radiation unit 20 provided at one end of the printing head 10 in the ink-jet printing apparatus. As shown in FIG. 3A, when the printing head 10 is moving in the direction of arrow A1, the ink ejection portions 11 of the head 10 eject ink and at the same time the ultraviolet radiation unit 20 radiates the ultraviolet light 21. When, as shown in FIG. 3B, the head 10 is moving in the direction of arrow A2, the ink ejection portions 11 of the head 10 do not eject ink, nor does the ultraviolet radiation unit 20 radiate the ultraviolet light. Radiating the ultraviolet light 21 from the ultraviolet radiation unit 20 situated in front of the head 10 with respect to the scan direction of arrow A1 in this way fixes the ink on a printed area of the paper P that was printed in the previous scan. Thus, when an image in a predetermined area on the printing paper P is to be completed with a plurality of scans of the printing head 10, the ultraviolet light does not need to be radiated during the first scan of the printing head 10. But after the last scan for the image printing, the printing head 10 must be scanned one more time for radiating the ultraviolet light.

Mist 30 generated during the printing flows rearward with respect to the scan direction as the printing head 10 performs the scan, so that it is not subjected to the ultraviolet light from the ultraviolet radiation unit 20 situated in front with respect to the scan direction. This printing control can prevent the harm done by the mist 30 when subjected to the ultraviolet radiation, i.e., the degradation of a printed image by the mist 30 hardened through ultraviolet radiation being scattered over the printed surface of the printing paper P or the weakening of the ultraviolet light intensity by the mist 30 adhering to the ultraviolet radiation unit 20 and becoming hardened.

(Fourth Embodiment)

Figure 4A:
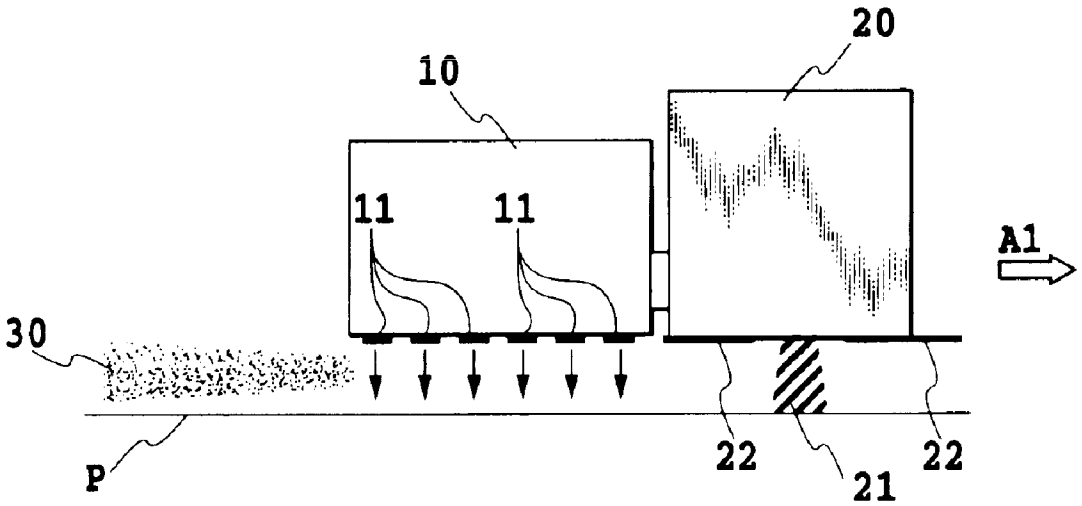
FIG. 4A is an explanatory diagram showing the printing head moving in one direction in a fourth embodiment of the present invention.
Figure 4B:
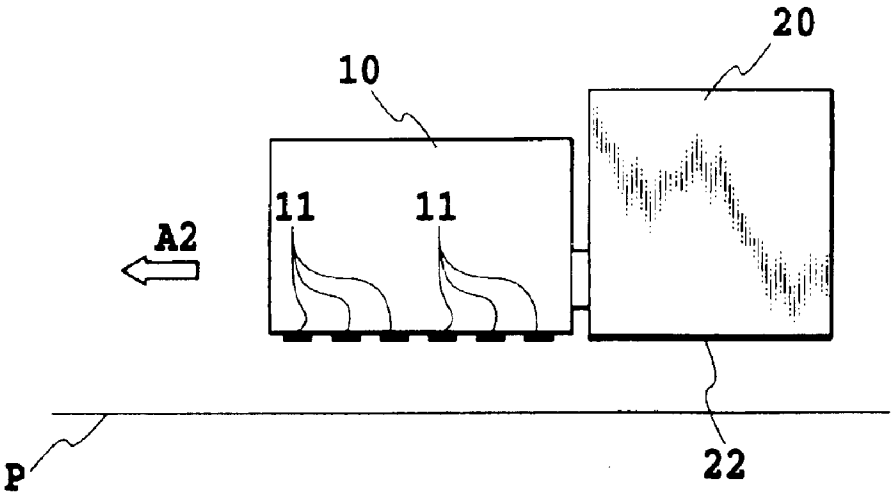
FIG. 4B is an explanatory diagram showing the printing head moving in the opposite direction in the fourth embodiment of the present invention.

FIG. 4A and FIG. 4B best illustrate the features of the fourth embodiment of the present invention.

This embodiment has a shutter 22 provided to the ultraviolet radiation unit 20 in the third embodiment. The shutter 22 opens to form a passage for the ultraviolet light 21 when the ultraviolet radiation unit 20 radiates the ultraviolet light 21, i.e., when the printing head 10 moves toward the right in the direction of arrow A1 as shown in FIG. 4A. When the ultraviolet radiation unit 20 does not radiate the ultraviolet light 21, the shutter 22 is closed to shield the ultraviolet radiation unit 20. As a result, the shutter 22 can more reliably prevent a possible weakening of the ultraviolet light intensity which would otherwise be caused by the mist 30 adhering to the ultraviolet radiation unit 20.

(Fifth Embodiment)

Figure 5A:
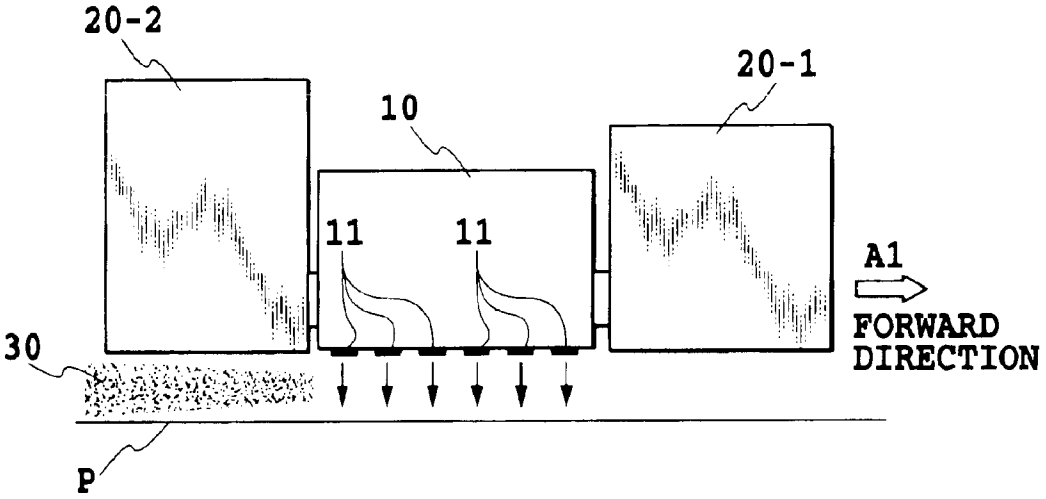
FIG. 5A is an explanatory diagram showing the printing head moving in one direction in a fifth embodiment of the present invention.
Figure 5B:
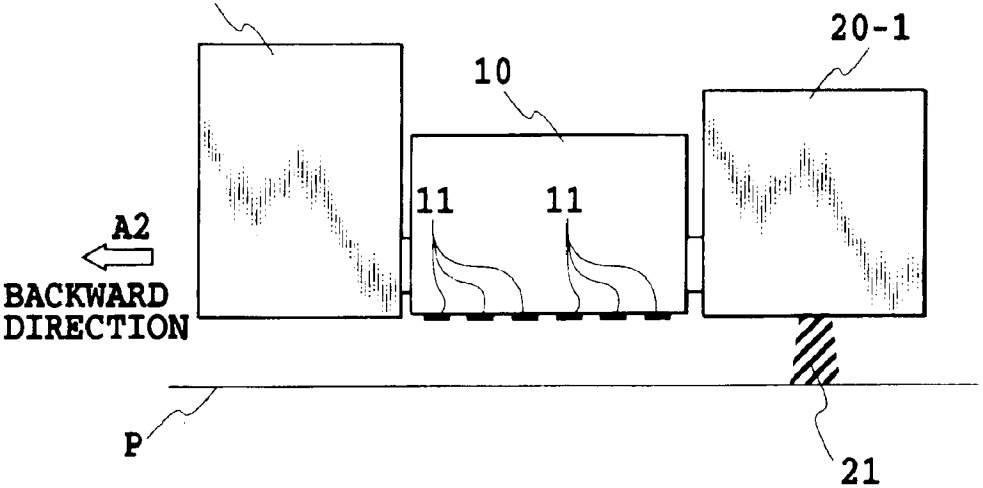
FIG. 5B is an explanatory diagram showing the printing head moving in the opposite direction in the fifth embodiment of the present invention.

FIG. 5A and FIG. 5B best illustrate the features of the fifth embodiment of the present invention.

This embodiment has ultraviolet radiation units 20 (20-1, 20-2) provided at both ends of the printing head 10 in the ink-jet printing apparatus. As shown in FIG. 5A, when the head 10 is moving in a forward direction, as indicated by an arrow A1, the ink ejection portions 11 eject ink. Then, as shown in FIG. 5B, when the head 10 is moving in a backward direction, as indicated by an arrow A2, the right side ultraviolet radiation unit 20-1 radiates the ultraviolet light 21. That is, when the printing head 10 moves in the forward direction, ink is printed on the printing paper P. During the subsequent backward movement of the printing head 10, the ultraviolet light 21 is radiated against the printed ink to fix it. Because the ink ejection or print timing and the ultraviolet light radiation timing differ, the mist 30 is prevented from being subjected to the ultraviolet light. Such a printing control can forestall a possible harm done by the mist 30 when subjected to the ultraviolet light.

In an opposite configuration to what is shown in FIGS. 5A and 5B, the ink ejection portions 11 of the printing head 10 may be made to eject ink when the printing head 10 moves in the backward direction as indicated by the arrow A2. Then when the head 10 moves in the forward direction as indicated by the arrow A1, the left side ultraviolet radiation unit 20-2 is made to radiate the ultraviolet light 21. In this case, ink is printed on the printing paper P during the backward movement of the printing head 10 and, during the subsequent forward movement of the printing head 10, the ultraviolet light 21 is applied to the ink to fix it.

(Sixth Embodiment)

Figure 6A:
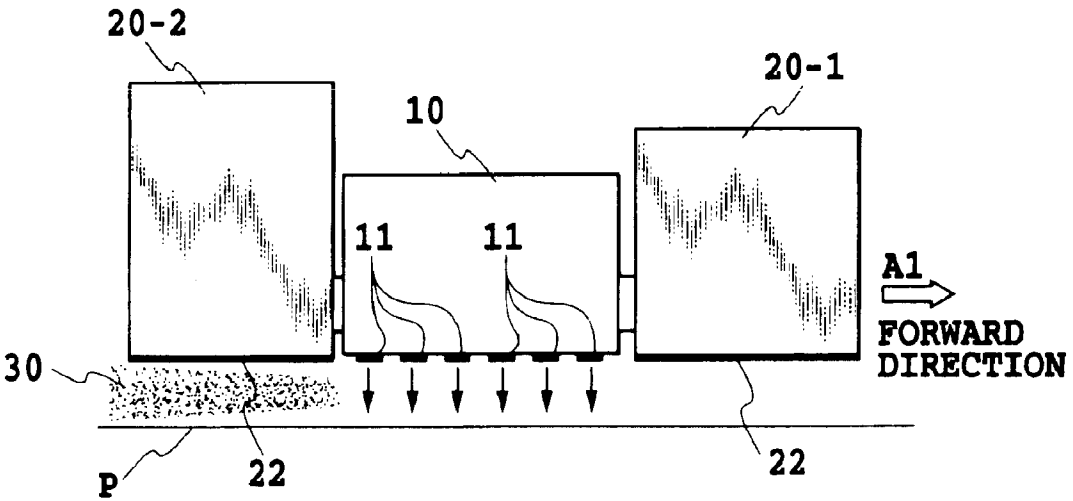
FIG. 6A is an explanatory diagram showing the printing head moving in one direction in a sixth embodiment of the present invention.
Figure 6B:
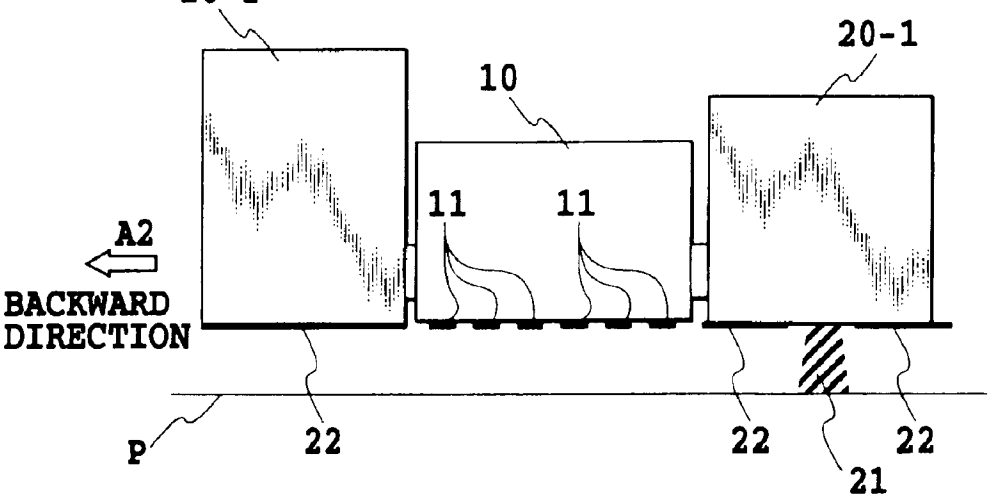
FIG. 6B is an explanatory diagram showing the printing head moving in the opposite direction in the sixth embodiment of the present invention.

FIG. 6A and FIG. 6B best illustrate the features of the sixth embodiment of the present invention.

This embodiment has shutters 22 provided to the ultraviolet radiation units 20 (20-1, 20-2) in the fifth embodiment. The shutter 22 on the right side ultraviolet radiation unit 20-1 opens to form a passage for the ultraviolet light 21 when the ultraviolet radiation unit 20-1 radiates the ultraviolet light 21, i.e., when the printing head 10 moves in a backward direction as indicated by arrow A2 of FIG. 6B. When the ultraviolet radiation unit 20-1 does not radiate the ultraviolet light 21, the shutter 22 is closed to shield the ultraviolet radiation unit 20-1. As a result, the shutter 22 can prevent a possible weakening of the ultraviolet light intensity which would otherwise be caused by the mist 30 adhering to the ultraviolet radiation unit 20.

In an opposite configuration to what is shown in FIGS. 6A and 6B, the ink ejection portions 11 of the printing head 10 may be made to eject ink when the head 10 moves in the backward direction as indicated by the arrow A2. Then when the printing head 10 moves in the forward direction as indicated by the arrow A1, the left side ultraviolet radiation unit 20-2 is made to radiate the ultraviolet light 21. In this case, the shutter 22 on the left side ultraviolet radiation unit 20-2 opens to form a passage for the ultraviolet light 21 when the ultraviolet radiation unit 20-2 radiates the ultraviolet light 21, i.e., when the printing head 10 moves in the forward direction as indicated by arrow A1. When the ultraviolet radiation unit 20-2 does not radiate the ultraviolet light 21, the shutter 22 is closed to shield the ultraviolet radiation unit 20-2. As a result, the shutter 22 can prevent a possible weakening of the ultraviolet light intensity which would otherwise be caused by the mist 30 adhering to the ultraviolet radiation unit 20-2.

(Seventh Embodiment)

Figure 7A:
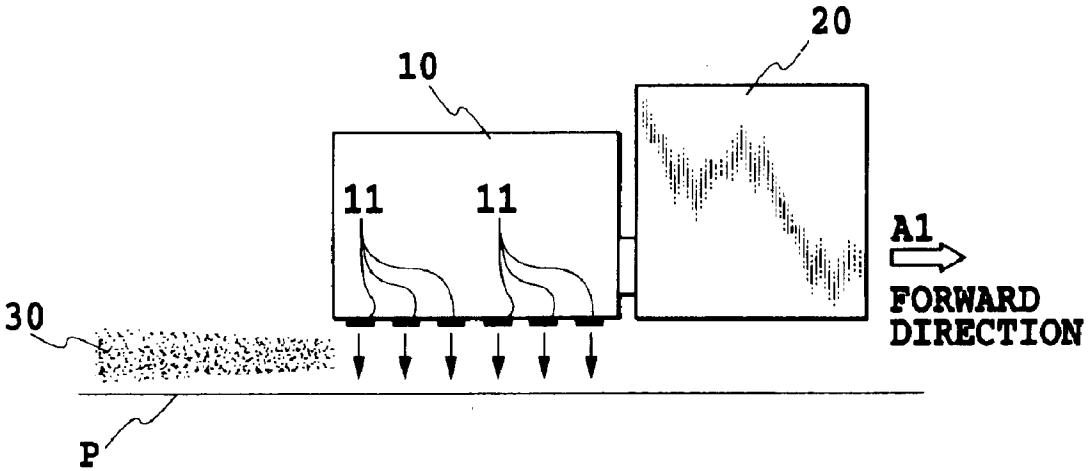
FIG. 7A is an explanatory diagram showing the printing head moving in one direction in a seventh embodiment of the present invention.
Figure 7B:
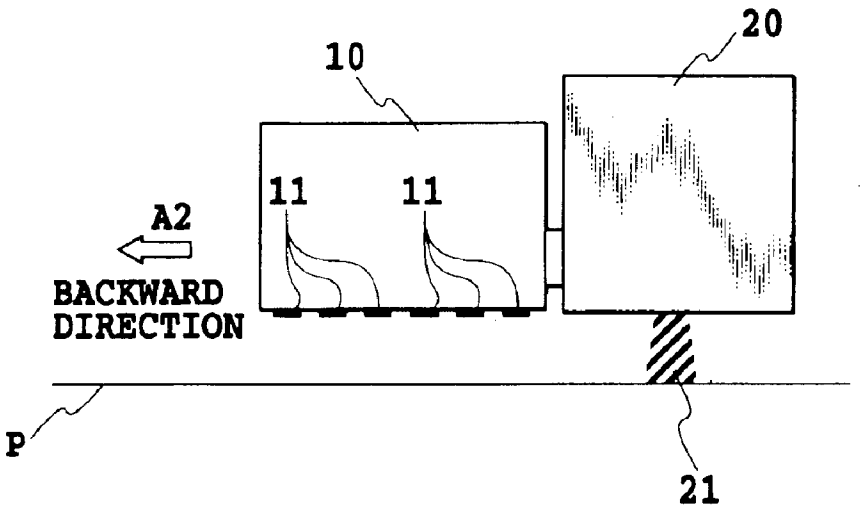
FIG. 7B is an explanatory diagram showing the printing head moving in the opposite direction in the seventh embodiment of the present invention.

FIG. 7A and FIG. 7B best illustrate the features of the seventh embodiment of the present invention.

This embodiment has an ultraviolet radiation unit 20 provided at the right-side end of the printing head 10 in the ink-jet printing apparatus. When, as shown in FIG. 7A, the printing head 10 moves in a forward direction as indicated by arrow A1, the ink ejection portions 11 of the printing head 10 eject ink. Then, when, as shown in FIG. 7B, the printing head 10 moves in the backward direction as indicated by arrow A2, the ultraviolet radiation unit 20 radiates the ultraviolet light 21. That is, ink is printed on the printing paper P as the printing head 10 moves in the forward direction. Then, when the printing head 10 moves in the backward direction, the printed ink is radiated with the ultraviolet light 21 for fixing. In this way, since the ink ejection or print timing and the ultraviolet light radiation timing differ, the mist 30 can avoid being subjected to the ultraviolet light. Such a printing control can prevent a possible harm done by the mist 30 when radiated with the ultraviolet light.

In an opposite configuration to what is shown in FIG. 7A and FIG. 7B, the ultraviolet radiation unit 20 may be provided at the left end of the printing head 10. In this case, when the printing head 10 moves in the backward direction as indicated by arrow A2, the ink ejection portions 11 of the printing head 10 are made to eject ink. Then, when the printing head 10 moves in the forward direction as indicated by arrow A1, the ultraviolet radiation unit 20 radiates the ultraviolet light 21. In this configuration, ink is printed on the printing paper P when the printing head 10 is moving in the backward direction and, during the subsequent forward movement, the ultraviolet light is radiated to the ink to fix it.

(Eighth Embodiment)

Figure 8A:
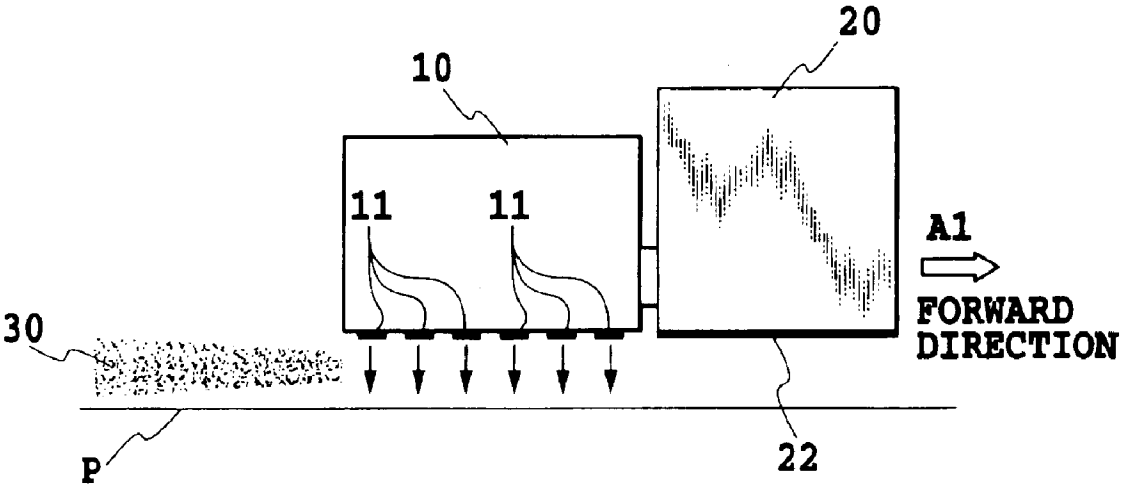
FIG. 8A is an explanatory diagram showing the printing head moving in one direction in an eighth embodiment of the present invention.
Figure 8B:
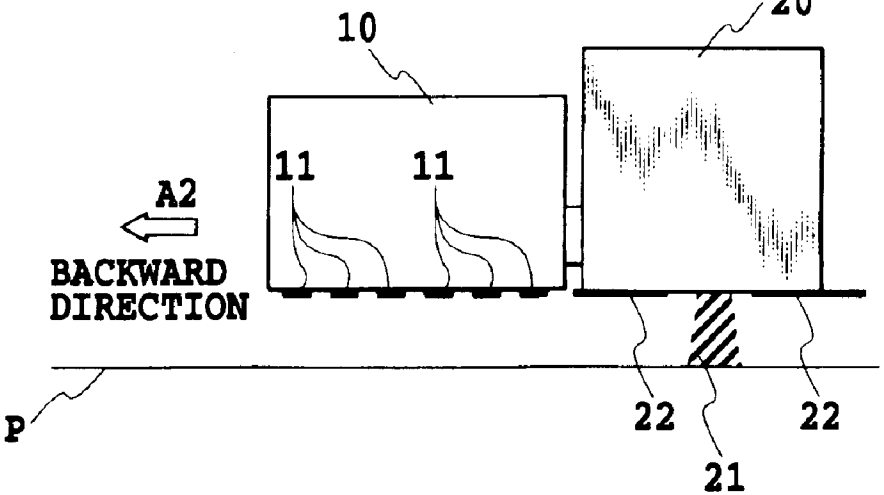
FIG. 8B is an explanatory diagram showing the printing head moving in the opposite direction in the eighth embodiment of the present invention.

FIG. 8A and FIG. 8B best illustrate the features of the eighth embodiment of the present invention.

This embodiment has a shutter 22 provided to the ultraviolet radiation unit 20 in the seventh embodiment. The shutter 22 on the ultraviolet radiation unit 20 opens to form a passage for the ultraviolet light 21 when the ultraviolet radiation unit 20 radiates the ultraviolet light 21, i.e., when the printing head 10 moves in a backward direction as indicated by arrow A2 of FIG. 8B. When the ultraviolet radiation unit 20 does not radiate the ultraviolet light 21, the shutter 22 is closed to shield the ultraviolet radiation unit 20. As a result, the shutter 22 can prevent a possible weakening of the ultraviolet light intensity which would otherwise be caused by the mist 30 adhering to the ultraviolet radiation unit 20

In an opposite configuration to what is shown in FIG. 8A and FIG. 8B, the ultraviolet radiation unit 20 and the shutter 22 may be provided at the left end of the printing head 10. In this case, when the printing head 10 moves in the backward direction as indicated by arrow A2, the ink ejection portions 11 of the printing head 10 are made to eject ink. Then, when the printing head 10 moves in the forward direction as indicated by arrow A1, the ultraviolet radiation unit 20 radiates the ultraviolet light 21. In this configuration, when the ultraviolet radiation unit 20 radiates the ultraviolet light 21, i.e., when the printing head 10 moves in the forward direction as indicated by arrow A1, the shutter 22 on the ultraviolet radiation unit 20 opens to form a passage for the ultraviolet light 21. When the ultraviolet radiation unit 20 does not radiate the ultraviolet light 21, the shutter 22 is closed to shield the ultraviolet radiation unit 20.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet printing apparatus using a printing head capable of ejecting ink from ink ejection portions to print on a printing medium while the printing head moves in a first main scan direction and a second main scan direction opposite to the first main scan direction, wherein the printing head is able to eject ink containing an ultraviolet curing agent, comprising:

a first ultraviolet radiation unit, positioned at a side of the printing head that leads when the printing head moves in the first main scan direction, for radiating an ultraviolet light to the ink adhered to the printing medium while moving with the printing head;

a second ultraviolet radiation unit, positioned at a side of the printing head that leads when the printing head moves in the second main scan direction, for radiating an ultraviolet light to the ink adhered on the printing medium while moving with the printing head; and control means for controlling said first ultraviolet radiation unit so as to radiate the ultraviolet light and said second ultraviolet radiation unit so as not to radiate the ultraviolet light when the printing head ejects ink while moving in the first main scan direction, and controlling said second ultraviolet radiation unit so as to radiate the ultraviolet light and said first ultraviolet radiation unit so as not to radiate the ultraviolet light when the printing head ejects ink while moving in the second main scan direction.

2. An ink-jet printing apparatus as claimed in claim 1, wherein two or more of said ink ejection portions are arranged along a moving direction of said printing head.

3. An ink-jet printing apparatus as claimed in claim 1, wherein said printing head has an electrothermal transducer that generates thermal energy for ejecting ink.

4. An ink-jet printing apparatus as claimed in claim 1, wherein said printing head has a piezoelectric element that generates ink ejection energy.

5. An ink-jet printing apparatus as claimed in claim 1, further comprising:

a shutter for shielding at least one of said first and second ultraviolet radiation units when said at least one of said first and second ultraviolet radiation units does not radiate the ultraviolet light.

6. An ink-jet printing apparatus as claimed in claim 1, wherein said control means controls said first and second ultraviolet radiation units so as not to radiate the ultraviolet light when the printing head first moves with respect to the printing medium and ink is ejected.

7. An ink-jet printing apparatus as claimed in claim 6, wherein said control means controls the printing head to move so as not to eject ink and controls at least one of said first and second ultraviolet radiation units to radiate the ultraviolet light onto ink ejected when the printing head was last moved with respect to the printing medium while ejecting ink.

* * * * *

UNITED STATES PATENT AND TRADEMARK OFFICE

CERTIFICATE OF CORRECTION

PATENT NO. : 6,953,245 B2
APPLICATION NO. : 10/180113
DATED : October 11, 2005
INVENTOR(S) : Shirakawa It is certified that error appears in the above-identified patent and that said Letters Patent is hereby corrected as shown below:

ON THE TITLE PAGE
Item (56), References Cited, FOREIGN PATENT DOCUMENTS, "63062738 A" should read --63-062738 A--.

COLUMN 4
Line 31, "unit" should read --unit.--.

COLUMN 6
Line 21, "property" should read --property of--.

COLUMN 10
Line 15, "unit 20" should read --unit 20.--.

Signed and Sealed this

Twenty-sixth Day of June, 2007

JON W. DUDAS
*Director of the United States Patent and Trademark Office*